United States Patent [19]

Dasan

[11] 4,021,018

[45] May 3, 1977

[54] JACKING DEVICE

[75] Inventor: Velu K. K. Dasan, Tamil Nadu, India

[73] Assignee: Ashok Kumar Shetty, Madras, India; a part interest

[22] Filed: May 10, 1976

[21] Appl. No.: 685,063

[52] U.S. Cl. ..... 254/93 H

[51] Int. Cl.[2] ..... B66F 3/24

[58] Field of Search ..... 254/93 R, 93 H, 93 HP

[56] References Cited

UNITED STATES PATENTS

| | | | |
|---|---|---|---|
| 2,024,291 | 12/1935 | Jackson et al. | 254/93 HP |
| 3,695,582 | 10/1972 | Clay | 254/93 HP |
| 3,831,901 | 8/1974 | Williams et al. | 254/93 R |

*Primary Examiner*—Al Lawrence Smith
*Assistant Examiner*—Robert C. Watson

[57] ABSTRACT

This invention relates to a lifting jack device for use with automobiles and the like. The jack includes a chamber for receipt of pressurized air constructed of a generally toroidal shape so as to resemble the configuration of a spare automobile tire. The central interior of the chamber is provided with cylinder and piston means operable by suitable valve means to extend a jack arm portion thereof outwardly and under pressure so as to impart lifting force to objects to be elevated. The entire jacking device is particularly adapted for placement beneath an automobile to lift a wheel thereof as for changing tires. Accordingly, the jack includes a relatively flat base portion and means for controlling the suitable valve mechanisms positioned at peripheral portions of the chamber so as to be readily accessible when the jack is placed in operable position beneath a car body.

8 Claims, 3 Drawing Figures

JACKING DEVICE

BACKGROUND OF THE INVENTION

Lifting jacks for automobiles are common and may take various alternative forms including those which form an integral portion of the vehicle itself and those which are separably portable therefrom. The present invention is directed to such portable jacks having various advantageous features and operating under pneumatic pressure.

OBJECTS OF THE INVENTION

Accordingly, an object of the present invention is to provide a jacking device for particular use with automobiles in an overall configuration which increases its stability when utilized to lift an automobile or the like.

A further object of the present invention is the provision of a lifting jack device for use with automobiles which can be conveniently stored and to this end of a configuration which similates that of a spare tire that accordingly can be stored in the same ways that have been extensively developed for spare tire storage.

A still further object of the present invention is the provision of a jacking device for automobiles and the like which presents convenient access of the various controls needed to manipulate its various operable valve mechanisms with ease when positioned and in use as an automobile jack.

DESCRIPTION OF THE PREFERRED EMBODIMENT

Figure 1:
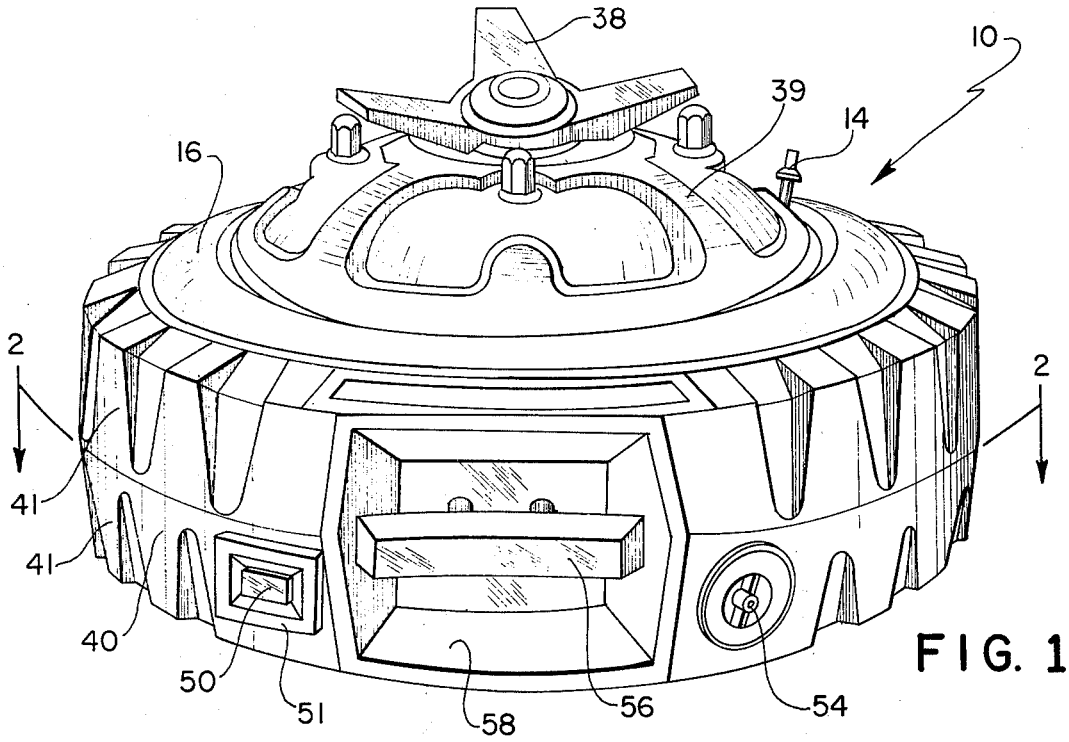
FIG. 1 is a perspective view of the present embodiment of the lifting jack device for automobiles and the like showing in particular the peripheral grouping of the various valve controls for ease of manipulative access during operation of the device.
Figure 2:
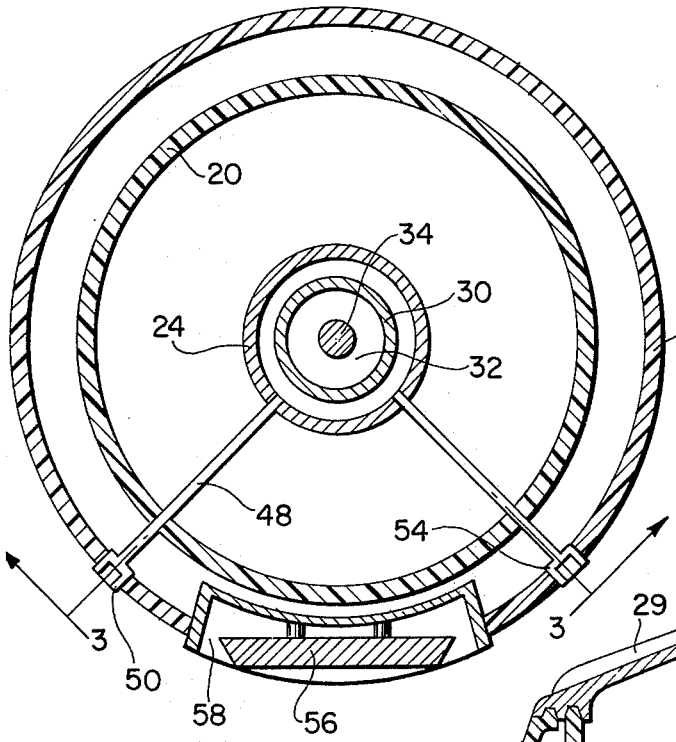
FIG. 2 is a partially stylized top sectional view thereof taken along the line 2—2 of FIG. 1.
Figure 3:
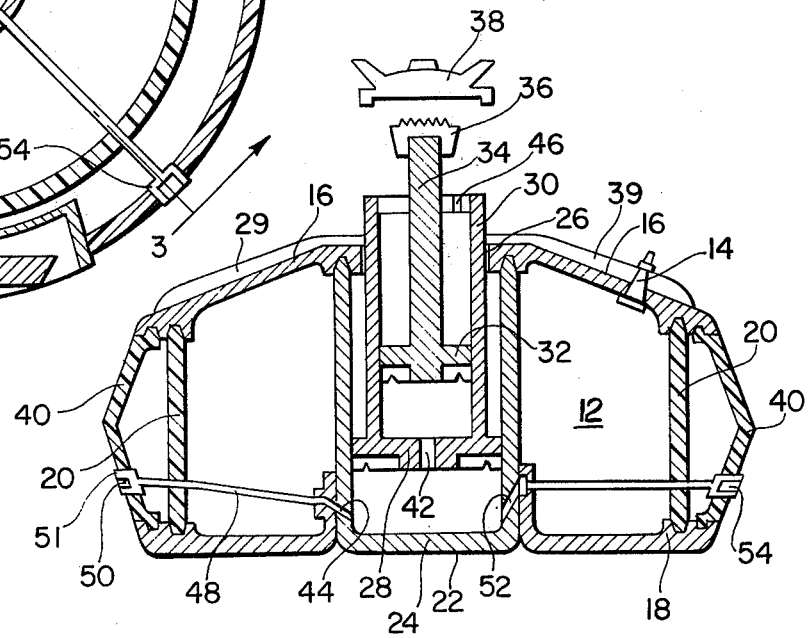
FIG. 3 is a side sectional view thereof taken along the line 3—3 of FIG. 2.

Referring to the drawings, and particularly FIG. 1, a jacking device 10 of the present invention is shown of an overall cylindrical shape to resemble an automobile spare tire and includes a chamber 12 of toroidal configuration for receipt of pressurized air through a conventional valve 14. The chamber 12 is preferably in part defined by upper 16 and lower 18 circular plates preferably fabricated from suitable plastic materials such as rigid PVC or ABS. A generally cylindrical band 20 of similar material is attached as by melt welding, mechanical interlock or glueing to the plates 16, 18 at outer radial portions thereof as shown. A cylinder 22 having a closed bottom 24 and an open top 26 is similarly connected to the plates 16 and 18 but at inner radial portions thereof as shown completes the enclosed configuration of the chamber 12. Although light weight high strength plastic materials are preferred for the construction of the chamber 12 so as to assure easy handling by all, including women, other materials and their appropriate assembly modes are however not excluded.

The cylinder is provided internally with a piston 28 operable for longitudinal movement within the cylinder 22 and of itself may comprise the actuation system of the jacking device or as depicted in the drawing further includes a secondary cylinder 30 and piston 28 integral therewith and positioned within the first cylinder 22 and in which a second piston 32 having a jacking arm 34 attached thereto is operably positioned therein. The prefered embodiment is that as depicted wherein the cylinder 22 is provided with a plurality of pistons 28 and 32 disposed one within the other in telescoping relationship. The end of the jacking arm 34 is provided with a member 36 for contact with undercarriage portions of an automobile to be lifted.

The entire piston assembly is adapted for receipt completely within the confines of the cylinder 22 when in an inactive non-pressurized condition. In such position a simulated hubcap device 38 is adapted to fit snugly into the open top 26 of cylinder 22 so as to prevent foreign matter from entering the cylinder and to enhance the sports type automobile tire configuration desired. In that regard the outer portions of the chamber are also provided with a plurality raised rib portions 29 integral with plate 16 to simulate the appearance of a tire rim and a simulated tire tread 40 of cylindrical configuration which may be snap fit engaged to the chamber as shown. The entire tread portion 40 is formed of two substantially circular halves 41 joined together as by snap fit engagement with each other along the horizontal center line depicted. Also the ribs 39 serve to stiffen and thus reinforce the plate 16 against deformation by the pressure within chamber 12.

The first piston 28 is provided with port 42 so that when pressurized air is admitted through valve 44 both the first piston 28 and the second piston 32 and its jacking arm 34 rise in telescoping relationship thereby lifting the laod. During such movement, air otherwise trapped on the unpressurized side of the cylinder 30, is exhausted through opening 46. The valve 44 is of a one way normally spring closed type and actuated by an arm 48 having an actuator 50 held within a seat 51 and adapted to be inwardly pushed against the spring pressure of valve 44 so as to admit pressurized air from the chamber 12 into cylinder 22 and its piston assembly. The pneumatic pressure exerted to the piston assembly thus serves to force the jacking arm 34 upwardly so as to accomplish the necessary lifting action sought.

The spring tension of valve 44 is so designed, that it will keep the valve closed up to a certain predetermined pressure inside chamber 12. Once this is exceeded, this valve 44 will open automatically, without manual depression of actuator 50 and as a result thereof, pistons 28 and 32 will extend outwardly of chamber 12 and, if necessary, pushing out 38 in the process. This serves as a visual indication of over pressurizing. Thus valve 44 in addition to being an inlet valve also serves as a safety valve, however an additional safety valve can also be incorporated if necessary.

In order to withdraw the piston assembly within the cylinder 22 a relief port 52 is provided through cylinder 22 and connected with conventional normally spring closed valve 54 grouped in close proximity with valve actuator 50 along the peripherial portions of the simulated tire tread 40. In this manner then pressurized air within the cylinder may bleed off through valve 52 upon its actuation enabling the piston assembly to entirely retract within the confines of the cylinder 22 and its surrounding chamber 12.

A safety valve (not shown) is provided within the chamber 12 so such will not be overpressurized. Also as best may be seen by reference to FIG. 1 of the drawing, a handle 56 for convenience in moving the jacking device 10 from its mounting position and throughout its various use positions is provided and preferably mounted between valve 54 and valve actuator 50 within a cut out portion 58 of the tread 40.

It should be particularly noted that the base 18 of the chamber 12 is of relatively flat configuration and that the closed base 24 of the cylinder 22 is positioned in line therewith so as to present a chamber base of overall flat configuration. This provides a more stable platform from which the jacking operation contemplated for the present invention may be carried out. It is particularly helpful in areas in which the terrain encountered is soft as in wet marshy type or sandy desert type areas.

Also for a jack to be used in lifting an automobile, its overall height must be such that it enters the clearance available underneath the vehicle. This limiting factor on the height of the jack also limits the height of lift since a single piston can only travel the length of the cylinder in which it slides, and the length of this cylinder in turn is limited by the overall height of the jack. In the device of the present invention the telescoping nature of multiple pistons satisfies the first condition in that all pistons retract within each other and hence the overall height of the jack can be small enough to enter the smallest clearance. When the pistons are pushed out, the telescoping nature will give a higher lift than is provided with a single piston. Hence this jack can serve a wide range of automobiles, provided they fall within its load carrying capacity.

It should be further understood that variations and modifications and special adaptions of the embodiments of the present invention may be utilized without departing from the scope of the present invention as set forth in the following claims.

I claim:

1. A lifting jack device for automobiles and the like having the overall shape of an automobile tire and rim and accordingly adapted for storage in similar attitudes comprising, a generally planar supporting base for supporting said device in an operative jacking mode, a closed chamber for receipt of pressurized air, said chamber of generally toroidal configuration including a central opening therethrough and having a relatively flat base of ring-like configuration, a cylinder having a closed lower base portion and an open top disposed entirely within the opening of said chamber, said cylinder base portion disposed within the confines of said ring-like chamber base and generally coplanar therewith so as to cooperatively form said supporting base, at least one piston longitudinally slidable within said cylinder and closing said open top thereof, said piston having a jack arm connected thereto and longitudinally extendable beyond said chamber for application of thrust to objects to be lifted by means of the application of pressurized air to said piston, and separate valve means for pressurizing said chamber with air for admitting pressurized air from said chamber to said cylinder beneath said piston and for withdrawing pressurized air from said cylinder.

2. The lifting jack device of claim 1 wherein said separate valve means include valve means for pressurizing said chamber with air, valve means including controls therefor extending through said chamber into and communicating with said cylinder for admitting pressurized air from said chamber to said cylinder beneath said piston and for withdrawing pressurized air from said cylinder.

3. The lifting jack device of claim 1 wherein said cylinder is provided with a plurality of pistons disposed one within the other in telescoping relationship.

4. The lifting jack device of claim 3 wherein all the pistons are operable to move outwardly with respect to said cylinder so as to cause the innermost piston to apply a thrust to such object.

5. The lifting jack device of claim 1 wherein said jack arm is in the form of a rod and the free extremity of said rod is of a shape adapted for lifting contact with such object.

6. The lifting jack device of claim 1 wherein the chamber is provided with an air bleed valve of the spring loaded, self-closing type adapted to open and bleed the said chamber of air whenever pressure therein exceeds predetermined value.

7. The lifting jack device of claim 2 wherein said valve means for admitting pressurized air from said chamber to said cylinder includes a spring loaded self-closing valve interiorly of said chamber and means disposed along the outside periphery of said chamber for actuating the opening of said valve.

8. The lifting jack device of claim 2 wherein all said separate valve means include actuation means, all said actuation means disposed along the outside periphery of said chamber.

* * * * *